US007348524B2

(12) United States Patent
Takematsu et al.

(10) Patent No.: US 7,348,524 B2
(45) Date of Patent: Mar. 25, 2008

(54) IMAGE FORMING APPARATUS

(75) Inventors: Koji Takematsu, Toride (JP); Koki Watanabe, Moriya (JP); Shinichiro Wakahara, Tokyo (JP); Jiro Shirakata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 11/255,149

(22) Filed: Oct. 21, 2005

(65) Prior Publication Data

US 2006/0086727 A1 Apr. 27, 2006

(30) Foreign Application Priority Data

Oct. 22, 2004 (JP) ..... 2004-307530

(51) Int. Cl.
*H05B 6/14* (2006.01)

(52) U.S. Cl. ..... 219/619; 399/328

(58) Field of Classification Search ..... 219/619, 219/670, 660–667; 399/228–338
See application file for complete search history.

(56) References Cited

U.S. PATENT DOCUMENTS

| | | | | |
|---|---|---|---|---|
| 5,240,242 | A | 8/1993 | Ando et al. | 271/118 |
| 6,453,144 | B1 * | 9/2002 | Sato | 399/328 |
| 6,477,348 | B2 | 11/2002 | Miyamoto et al. | 399/299 |
| 6,801,726 | B2 | 10/2004 | Shimizu et al. | 399/44 |
| 6,832,066 | B2 | 12/2004 | Watanabe et al. | 399/299 |
| 7,099,616 | B2 | 8/2006 | Kato et al. | 399/328 |
| 7,122,769 | B2 * | 10/2006 | Nami et al. | 219/619 |
| 7,130,554 | B2 | 10/2006 | Takematsu | 399/69 |
| 2004/0253027 | A1 * | 12/2004 | Kato et al. | 399/328 |
| 2006/0086722 | A1 | 4/2006 | Takematsu et al. | 219/619 |
| 2006/0088333 | A1 | 4/2006 | Watanabe et al. | 399/107 |
| 2006/0120744 | A1 | 6/2006 | Shirakata et al. | 399/68 |
| 2006/0138126 | A1 | 6/2006 | Watanabe | 219/619 |
| 2006/0204292 | A1 | 9/2006 | Kato et al. | 399/328 |
| 2006/0222386 | A1 | 10/2006 | Koshida et al. | 399/44 |

FOREIGN PATENT DOCUMENTS

| | | |
|---|---|---|
| JP | 5-9027 | 1/1993 |
| JP | 2004-265670 | 9/2004 |

* cited by examiner

*Primary Examiner*—Quang Van
(74) *Attorney, Agent, or Firm*—Fitzpatrick, Cella, Harper & Scinto

(57) ABSTRACT

An image heating device has a magnetic flux generator, a heat generating element for generating heat by a magnetic flux from the magnetic flux generator; a magnetic flux confining member, the magnetic flux confining member including a magnetic flux confining portion for confining the magnetic flux directed toward a predetermined region of the heat generating element at a predetermined magnetic flux confining position and a connecting portion connecting with the magnetic flux confining portion in a longitudinal direction of the heat generating element to hold the magnetic flux confining portion; and a moving unit for moving the magnetic flux confining member to a magnetic flux confining position or to a retracted position where the magnetic flux confining member is retracted from the magnetic flux confining position, wherein the connecting portion has a regulating member for preventing movement to the magnetic flux confining position.

17 Claims, 15 Drawing Sheets

IMAGE FORMING APPARATUS

FIELD OF THE INVENTION AND RELATED ART

The present invention relates to an image forming apparatus which heats an image on recording medium with the use of a heating method based on electromagnetic induction. More specifically, it relates to an apparatus for modifying an image on recording medium in glossiness, a fixing apparatus for fixing an unfixed image on recording medium, etc.

A heating method based on electromagnetic induction has been employed as the heating method for a thermal fixing apparatus for heating an image on recording medium.

An image heating apparatus employing a heating method based on electromagnetic induction (which hereinafter may be referred to simply as inductive heating method) is made up of a heating member in which heat (Joule heat) is generated, and a magnetic field generating means which generates a magnetic field. In operation, the heating member is heated by the heat generated therein by the eddy current induced in the heating member by the magnetic field generated the magnetic field generating means, and the thus generated heat is applied to recording medium as an object to be heated, and the image thereon, to thermally fix the image to the recording medium.

Japanese Patent Application Publication 5-9027 discloses an apparatus which heats its fixation roller (formed of a ferrous substance) by the function of the magnetic flux generated by a coil. In the case of this apparatus, the portion(s) of the heating member, in which heat is generated by the magnetic flux, can be placed closer to a fixation nip, compared to an apparatus employing a heat roller, the heat source of which is a halogen lamp. Therefore, this apparatus is higher in efficiency than an apparatus employing a heat roller, the heat source of which is a halogen lamp.

Japanese Laid-open Patent Application 2004-265670 discloses a heating apparatus characterized in that it is provided with a magnetic flux blocking member for varying the density distribution of the magnetic flux in terms of the lengthwise direction of the fixation roller (width direction of fixation film). This heating apparatus presents an example of how to solve the so-called out-of-path temperature increase, that is, the phenomenon that as multiple sheets of recording medium of a size smaller than that of the largest sheet of recording medium conveyable through an inductive fixing apparatus, the portions of the fixation roller between the lateral edges of the path of a sheet of recording medium of a smaller size and the corresponding lateral edges of the path of a sheet of recording medium of the largest size abnormally increase in temperature.

However, it is possible to surmise that the apparatus disclosed in Japanese Laid-open Patent Application suffers from the following problem. That is, if the control portion which controls the movement of the magnetic flux controlling member, or the portion for driving the magnetic flux controlling member goes out of order while the magnetic flux controlling member is being rotated, the position of the magnetic flux controlling member becomes unclear. This is true with the malfunction of the position sensor used for controlling the rotation of the magnetic flux controlling means; if the position sensor goes out of order, the position of the magnetic flux controlling member becomes unclear. In these cases, it is possible that the magnetic flux adjustment area, which opposes the end surface of the portion of the core around which the coil is wound, in terms of the radius direction of the holder 6, (the cross section of the core is in the shape of letter T; the coil is wound around the center core, that is, the portion of the core equivalent to the horizontal portion of the letter T; and the magnetic flux is highest in density around the end surface of the this portion of the core), will be entirely covered with the connective portion of the magnetic flux blocking member, in terms of the lengthwise direction of the core. If the end surface of the center core remains covered by the magnetic flux blocking member, the problem that the magnetic flux blocking member and/or coil abnormally increases in temperature occurs. Further, if the heating member is shielded by the magnetic flux blocking member across the entirety of the portions across which the magnetic flux is to be controlled, the problem that the value of the apparent impedance L of the coil suddenly reduces, allowing a large amount of electric current to flow, which sometimes destroys the electric power source, occurs.

SUMMARY OF THE INVENTION

Thus, the primary object of the present invention is to prevent the problem attributable to the movement of the connective portion of the magnetic flux controlling means into a preset magnetic flux controlling position.

According to an aspect of the present invention, there is provided an image heating device comprising magnetic flux generating means; a heat generating element for generating heat by a magnetic flux from said magnetic flux generating means to heat an image on a recording material; a magnetic flux confining member for confining the magnetic flux directed toward said heat generating element from said magnetic flux generating means, said magnetic flux confining member including a magnetic flux confining portion for confining the magnetic flux directed toward a predetermined region of said heat generating element at a predetermined magnetic flux confining position and a connecting portion connecting with said magnetic flux confining portion in a longitudinal direction of said heat generating element to hold said magnetic flux confining portion; and moving means for moving said magnetic flux confining member to a magnetic flux confining position or to a retracted position where said magnetic flux confining member is retracted from said magnetic flux confining position, wherein said connecting portion has a regulating member for preventing movement to said magnetic flux confining position.

According to another aspect of the present invention, there is provided an image heating apparatus comprising a heating rotatable member for heating an image on a recording material; an excitation coil for induction heat generation in induction heat generation; an electric power supplying means for supplying electric power to said excitation coil; a magnetic flux confining means for confining the magnetic flux directed toward said heating rotatable member from said excitation coil, said magnetic flux confining means including a first magnetic flux confining portion, a second magnetic flux confining portion, and a connecting portion for connecting said first magnetic flux confining portion and said second magnetic flux confining portion; rotating means for rotation said magnetic flux confining means between a magnetic flux confining position and a retracted position retracted from the magnetic flux confining position; a regulating member for stopping the rotation of said magnetic flux confining means beyond a-predetermined rotatable range including the magnetic flux confining position and the retracted position.

According to a further aspect of the present invention, there is provided an image heating apparatus comprising a heating rotatable member for heating an image on a recording material; an excitation coil for induction heat generation in said heating rotatable member; electric power supplying means for supplying electric power to said excitation coil; a rotatable magnetic flux confining member for confining a magnetic flux directed toward a predetermined region of said heating rotatable member from said excitation coil, said magnetic flux confining member is capable of being positioned at a magnetic flux confining position and at a retracted position retracted from the magnetic flux confining position; a supporting member for rotatably supporting at each of opposite longitudinal ends of said magnetic flux confining member; and a regulating member for limiting rotation of said magnetic flux confining member beyond a predetermined rotatable range including the magnetic flux confining position and the retracted position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

(1) Example of Image Forming Apparatus

Figure 1:
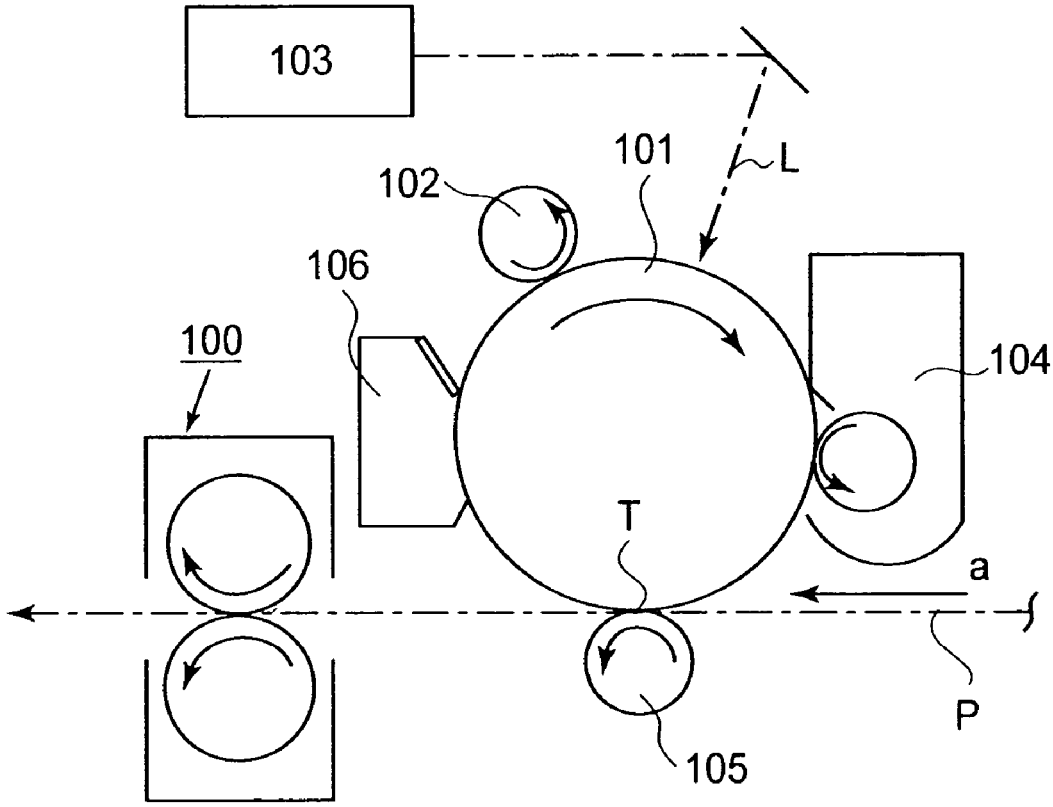
FIG. 1 is a schematic drawing of a typical image forming apparatus, showing the general structure thereof.

FIG. 1 is a schematic drawing of an example of an image forming apparatus employing the heating apparatus, in accordance with the present invention, employing a heating method based on electromagnetic induction as a thermal image heating apparatus (which hereinafter will be referred to simply as fixing apparatus). This example of an image forming apparatus is a laser printer of the transfer type employing an electrophotographic process.

Designated by a referential symbol 101 is an electrophotographic photosensitive member in the form of a rotatable drum (which hereinafter will be referred to simply as photosensitive drum). The photosensitive drum 101 is rotationally driven at a preset peripheral velocity in the clockwise direction indicated by an arrow mark.

Designated by a referential symbol 102 is a charge roller, as a charging means, of the contact type, which uniformly charges to predetermined polarity and potential level, the peripheral surface of the photosensitive drum 101 while the photosensitive drum 101 is rotated.

Designated by a referential symbol 103 is a laser scanner as an exposing means. The laser scanner scans, exposing thereby, the uniformly charged peripheral surface of the photosensitive drum 101 by outputting a beam of laser light L, while modulating it with the sequential digital electric video signals which reflect the image formation data. As a result, an electrostatic latent image is formed, which reflects the pattern in which the peripheral surface of the photosensitive drum 101 is scanned (exposed).

Designated by a referential symbol 104 is a developing apparatus, which develops, reversely or normally, the electrostatic latent image on the peripheral surface of the photosensitive drum 101 into an image formed of toner (which hereinafter will be referred to as toner image).

Designated by a referential symbol 105 is a transfer roller as a transferring means, which is kept pressed upon the peripheral surface of the photosensitive drum 101 with the application of a preset amount of pressure, forming a transfer nip T, to which a recording medium P as an object to be heated is conveyed from an unshown recording medium feeding/conveying mechanism with a preset control timing, and then, is conveyed through the transfer nip T while remaining pinched by the photosensitive drum 101 and transfer roller 105. As the recording medium P is conveyed through the transfer nip T, a preset transfer bias is applied to the transfer roller 105 with a preset control timing. As a result, the toner image on the peripheral surface of the photosensitive drum 101 is electrostatically and gradually transferred onto the surface of the recording medium P.

After being conveyed out of the transfer nip T, the recording medium P is separated from the peripheral surface of the photosensitive drum 101, and introduced into the fixing apparatus 100, which fixes the unfixed toner image on the recording medium P by applying heat and pressure to the introduced recording medium P and the unfixed toner image thereon; it turns the unfixed image into a permanent image. After the fixation, the recording medium P is conveyed out of the fixing apparatus.

Designated by a referential symbol 106 is a device for cleaning the photosensitive drum 101, which removes the transfer residual toner, that is, the toner remaining on the peripheral surface of the photosensitive drum 101 after the separation of the recording medium P from the peripheral surface of the photosensitive drum 101. After the cleaning of the peripheral surface of the photosensitive drum 101, that is, the removal of the transfer residual toner, the peripheral surface of the photosensitive drum 101 is used for the following image formation cycle; the peripheral surface of the photosensitive drum 101 is repeatedly used for image formation.

The direction indicated by a referential symbol a is the direction in which the recording medium P is conveyed. As for the positioning of the recording medium P relative to the main assembly of the image forming apparatus, in terms of the direction perpendicular to the recording medium conveyance direction a, the recording medium P is conveyed through the main assembly so that the centerline of the recording medium P is kept aligned with the center of the fixation roller.

(2) Fixing Apparatus 100

Figure 2:
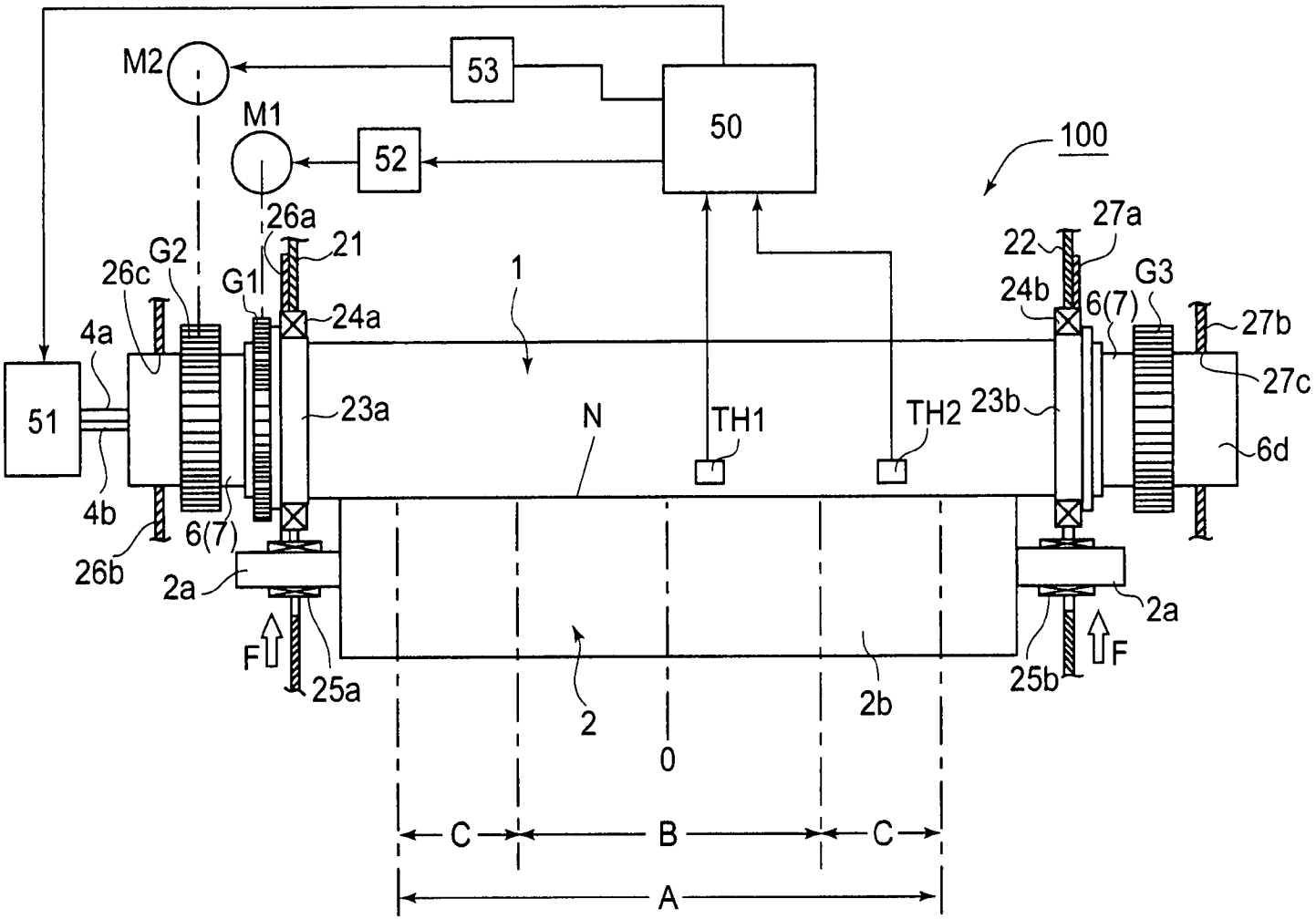
FIG. 2 is a schematic front view of the essential portions of the fixing apparatus.
Figure 3:
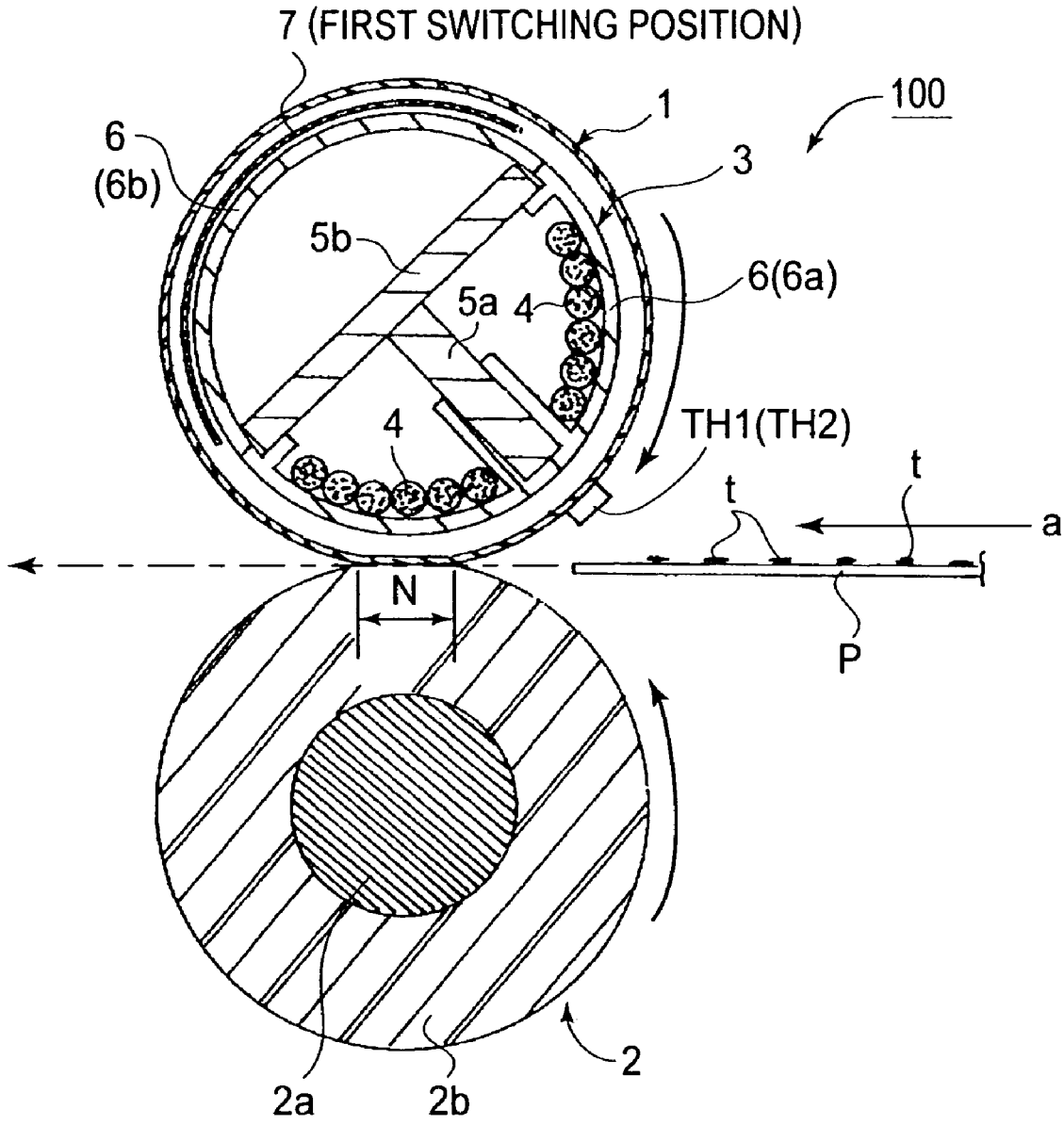
FIG. 3 is an enlarged schematic cross-sectional view of the essential portions of the fixing apparatus.
Figure 4:
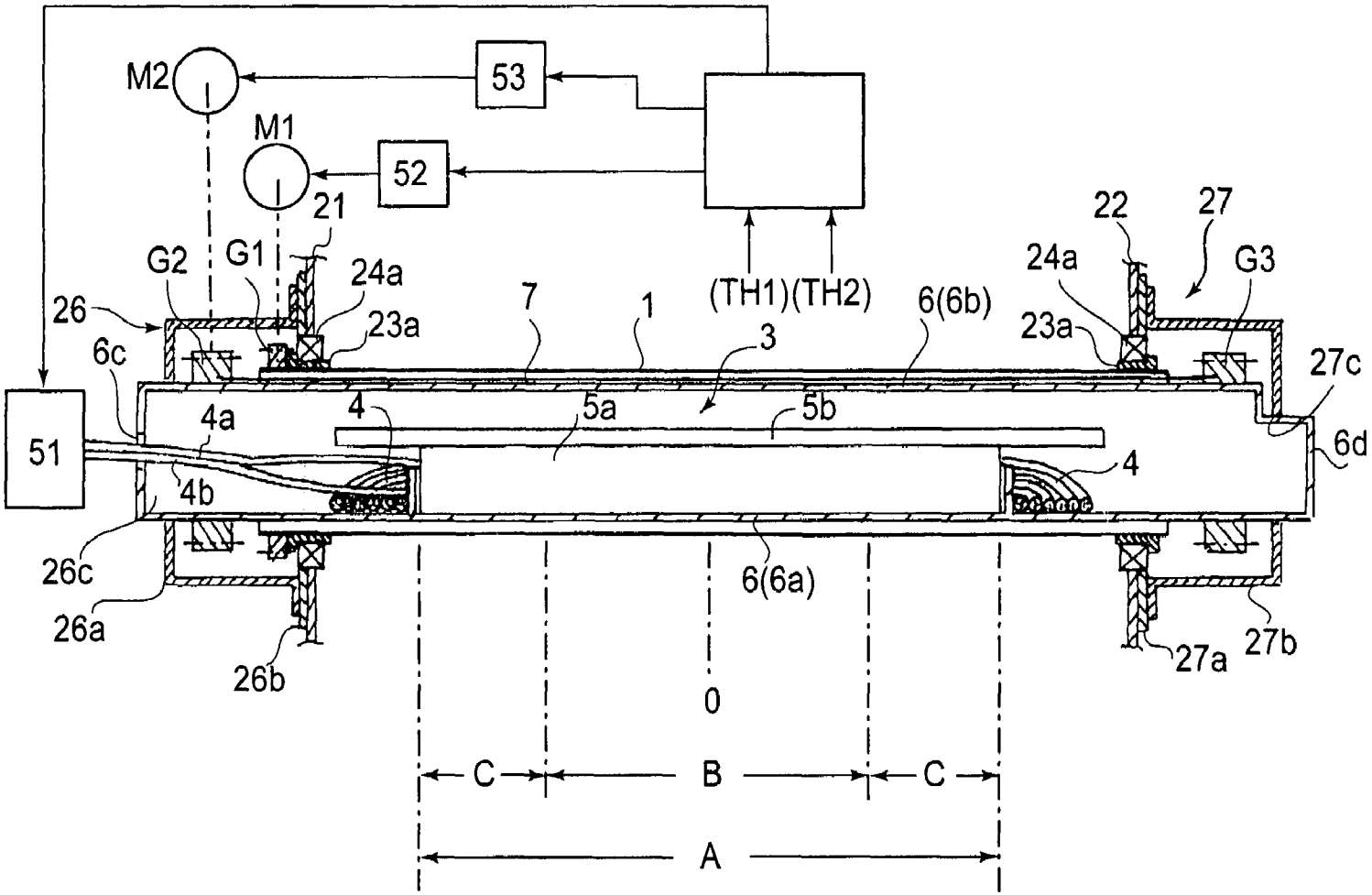
FIG. 4 is a schematic vertical sectional view of the fixation roller assembly portion of the fixing apparatus, at the plane parallel to the axial line of the fixation roller.

FIG. 2 is a schematic front view of the essential portions of the fixing apparatus as an image heating apparatus, and FIG. 3 is an enlarged schematic cross-sectional view of the essential portions of the fixing apparatus. FIG. 4 is a schematic vertical sectional view of the fixation roller assembly portion of the fixing apparatus.

<Fixation Roller>

Designated by a referential symbol 1 is the fixation roller as a member in which heat can be generated by electromagnetic induction. The fixation roller 1 is formed of such a substance as iron, nickel, and SUS 430 (electrically conductive magnetic substance), in which heat can be generated by electromagnetic induction. It is cylindrical, and the thickness of its wall is in the range of 0.1 mm-1.5 mm. Generally, it comprises a toner releasing layer as the surface layer, or the combination of a toner releasing layer, an elastic layer, etc. Using one of the ferromagnetic metals (metallic substances with high level of permeability), as the material for the fixation roller, makes it possible to confine a larger portion of the magnetic flux generated by the magnetic flux generating means, in the wall of the fixation roller 1. In other words, it makes it possible to increase the fixation roller in magnetic flux density, making it thereby possible to more efficiently induce eddy current in the surface portion of the metallic fixation roller.

This fixing apparatus 100 is provided with a front plate 21, a rear plate 22, a fixation roller supporting front member 26 (fixation roller positioning plate), a fixation roller supporting rear member 27 (fixation roller positioning plate). To the fixation roller supporting members 26 and 27, first supporting portions 26*a* and 27*a* are attached, respectively. The fixation roller 1 is provided with a pair of heat insulating bushings 23*a* and 23*b*, which are fitted around the lengthwise end portions of the fixation roller 1. It is rotatably supported at the front and rear lengthwise end portions by the portions 26*a* and 27*a* of the front and rear supporting members 26 and 27, with the interposition of bearings 24*a* and 24*b* disposed between the bushing 23*a* and the portion 26*a* of the front supporting member 26, and between the bushing 23*b* and portion 27*a* of the rear supporting member 27, respectively.

Figure 7:
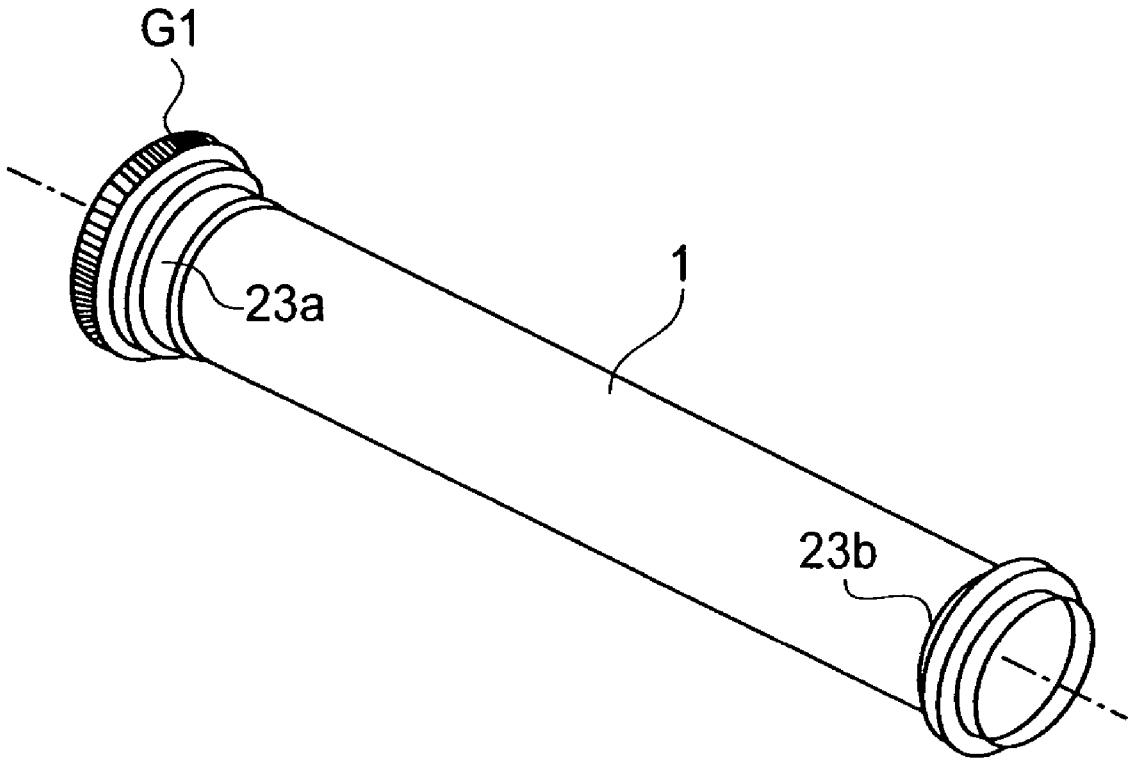
FIG. 7 is an external perspective view of the fixation roller to which the thermally insulative bushings and fixation roller have been attached.

The heat insulating bushings 23*a* and 23*b* are employed to minimize the heat transmission from the fixation roller 1 to the bearings 24*a* and 24*b*. Designated by a referential symbol G1 is a fixation roller driving gear fitted fast around the front end portion of the fixation roller 1. As the rotational force from a first motor M1 is transmitted to this gear G1 through a driving force transmission system (unshown), the fixation roller 1 is rotationally driven at a preset peripheral velocity in the clockwise direction indicated by an arrow mark in FIG. 3. FIG. 7 is an external perspective view of the fixation roller 1 fitted with the pair of heat insulating bushings 23*a* and 23*b* and the fixation roller gear G1.

Designated by a referential symbol 2 is a pressure roller as a pressure applying member, which is an elastic roller made up of a metallic core 2*a*, a cylindrical elastic layer 2*b* formed integrally and concentrically around the metallic core 2*a*, etc. The elastic layer 2*b* is a layer formed of a rubbery substance, for example, silicone rubber, which displays the releasing property and is heat resistant. This elastic roller 2 is disposed under the fixation roller, in parallel to the fixation roller, being rotatably supported by the front and rear end portions of the metallic core 2*a*, with a pair of bearings 25*a* and 25*b* attached to the front and rear plates 21 and 22, respectively, in such a manner that they can be slid toward the fixation roller 1. Further, the bearings 25*a* and 25*b* are kept pressured upward toward the fixation roller 1 by a pair of pressure applying means (unshown). With the provision of the above described structural arrangement, the pressure roller 2 is pressed against the downwardly facing portion of the peripheral surface of the fixation roller 1, so that a predetermined amount of contact pressure is maintained between the fixation roller 1 and pressure roller 2 against the elasticity of the elastic layer 2*b*. As a result, a fixation nip N, as a heating nip, with a preset width is formed between the fixation roller 1 and pressure roller 2. As the fixation roller 1 is rotationally driven, the pressure roller 2 is rotated by the friction which occurs between the fixation roller 1 and pressure roller 2 in the fixation nip N.

<Coil Assembly>

Figure 8:
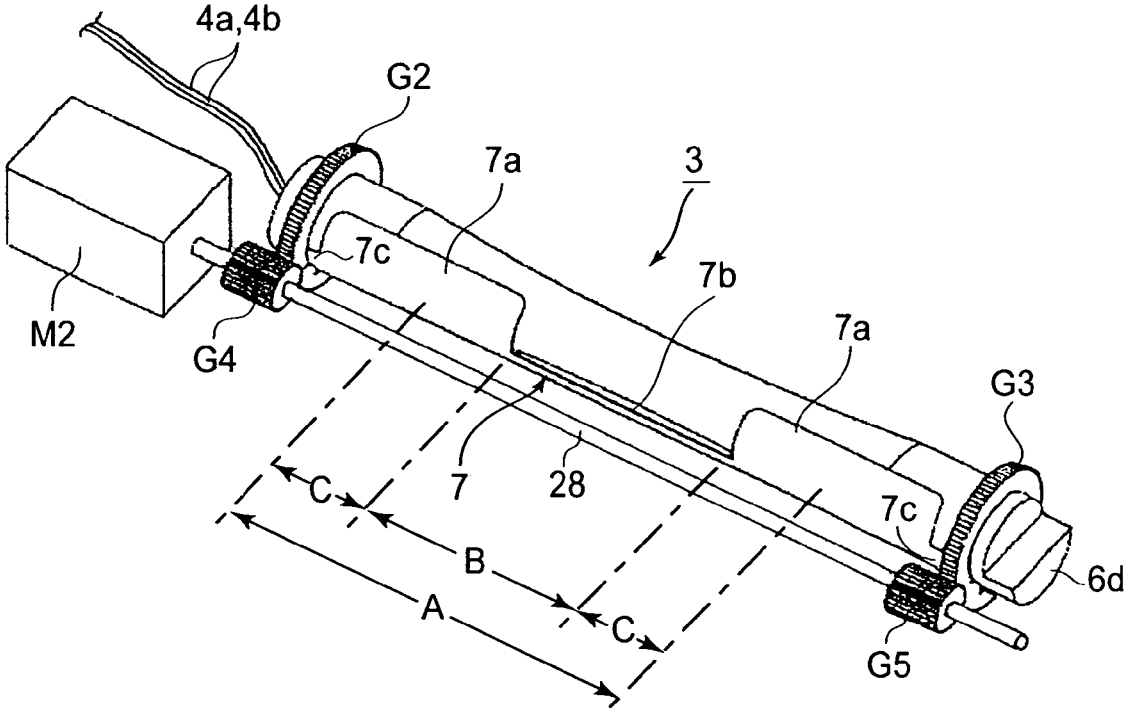
FIG. 8 is an external perspective view of the excitation coil and magnetic flux adjusting member moving means.
Figure 9:
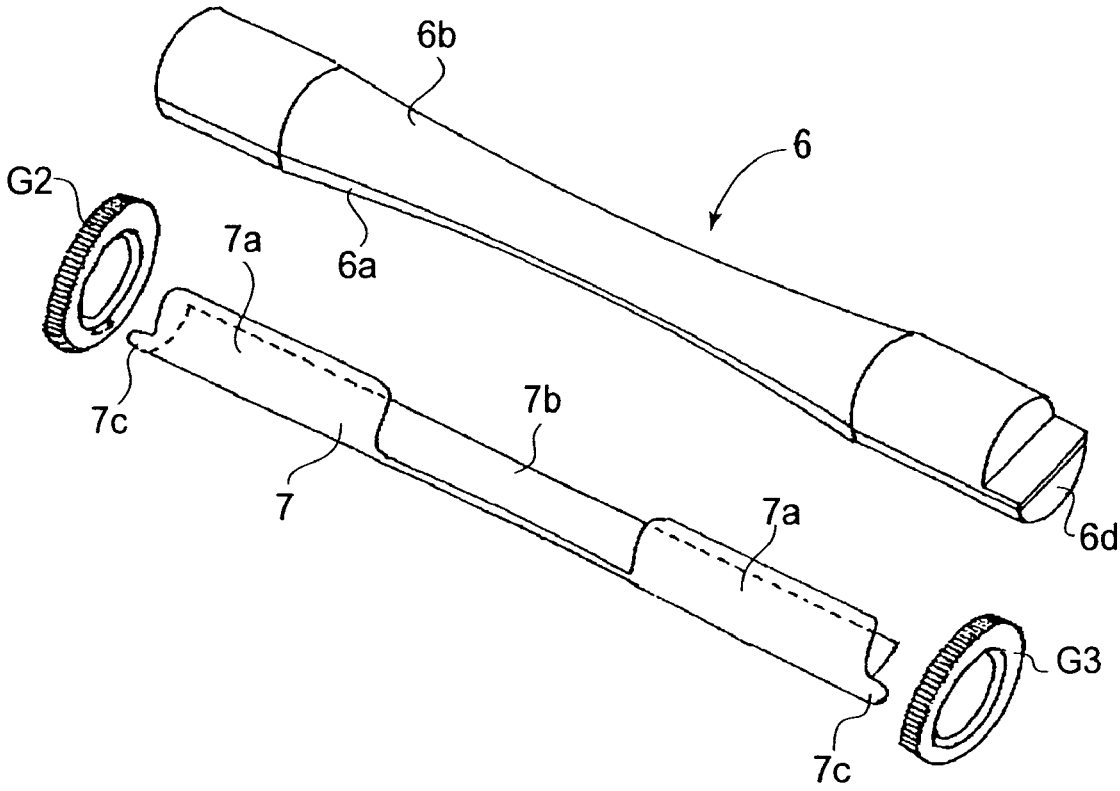
FIG. 9 is a perspective view of the exploded fixation roller assembly, showing the holder and magnetic flux adjusting member.
Figure 10:
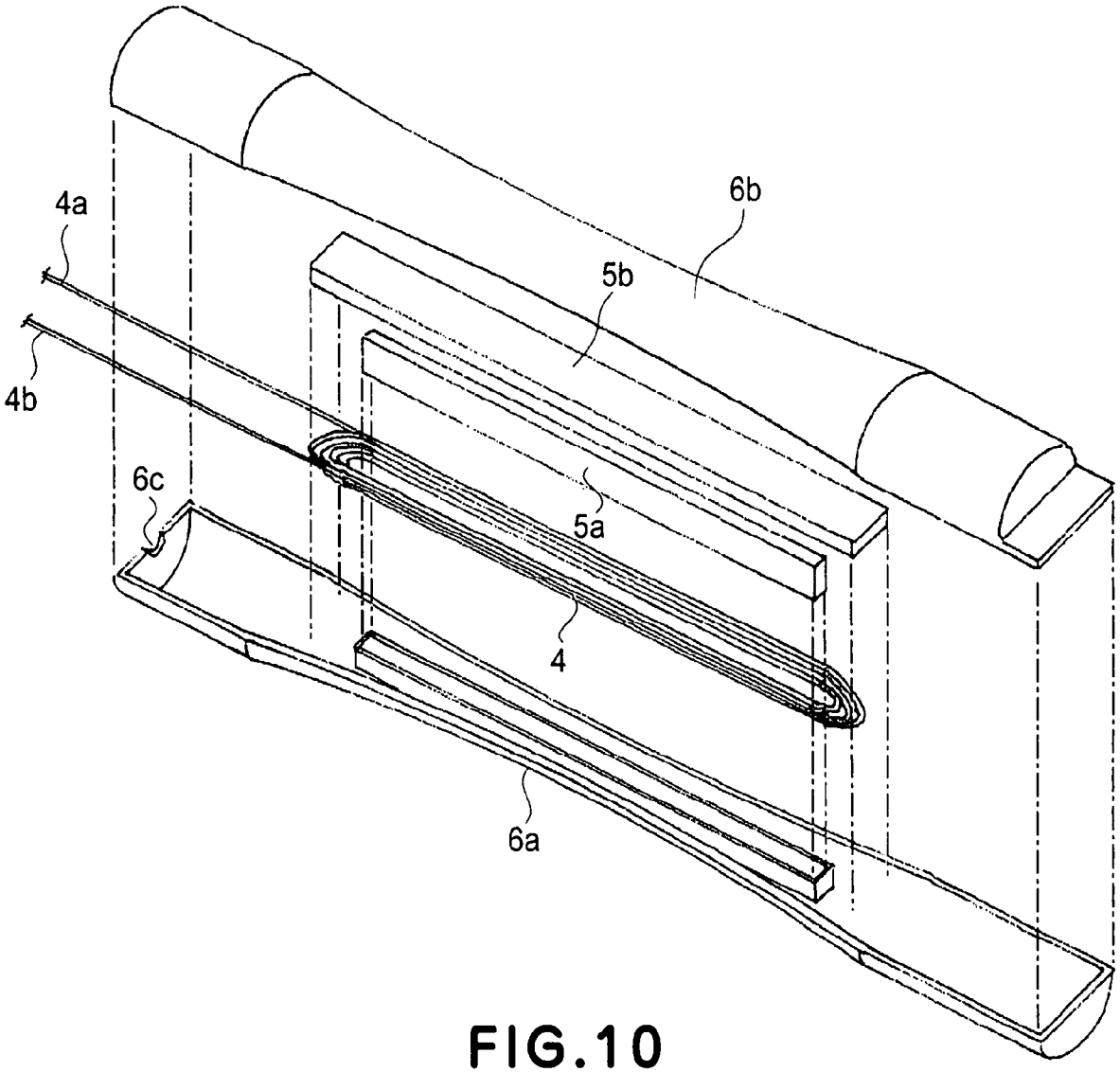
FIG. 10 is a perspective cut-away view of the fixation roller assembly, showing the interior of the holder.

Designated by a referential symbol 3 is an excitation coil assembly as a magnetic flux generating means. This excitation coil assembly 3 is disposed (inserted) in the hollow of the abovementioned cylindrical fixation roller 1. The excitation coil assembly 3 is made up of an excitation coil 4 (which hereinafter will be referred to simply as coil), magnetic cores 5*a* and 5*b* (which hereinafter will be referred to simply as cores), and a holder 6. The magnetic cores 5*a* and 5*b* are integrally attached to each other, yielding a component with a T-shaped cross section, and are disposed in the hollow of the holder 6. The excitation coil assembly 3 is also provided with a magnetic flux controlling member 7 (magnetic flux blocking member (magnetic flux reducing member): shutter), which is rotatably disposed on the outward side of the holder 6, coaxially with the holder 6. FIG. 8 is an external view of this excitation coil assembly 3 and means M2, 28, G4, and G5 for moving the magnetic flux controlling member 7. FIG. 9 is an exploded perspective view of the holder 6 and magnetic flux controlling member 7. FIG. 10 is an exploded perspective view of the holder 6, and the components therein.

Hereinafter, the lengthwise direction of the structural components or the portions thereof of the fixing apparatus means the direction perpendicular (intersectional) to the recording medium conveyance direction a.

The holder 6 is roughly cylindrical, being therefore roughly circular in cross section, from one lengthwise end to the other. As the material therefor, a mixture of PPS resin, which is heat resistant and has mechanical strength, and glass fiber, is used. As for the substances, other than the PPS resin, suitable as the material for the holder 6, PEEK resin, polyimide resin, polyamide resin, polyamide-imide resin, ceramic, liquid polymer, fluorinated resin, and the like are available.

Referring to FIG. 10, the holder 6 is made up of two (first and second) roughly semicylindrical portions 6*a* and 6*b*, which are attached to each other with adhesive, or are interlocked to each other by providing the two portions 6*a* and 6*b* with such a shape that makes it possible to interlock the two portions 6*a* and 6*b* with each other, to form the holder 6, which is roughly cylindrical, from one lengthwise end to the other. The coil 4 and cores 5*a* and 5*b* are disposed in the first semicylindrical portion 6*a*, and then, the second semicylindrical portion 6*b* is bonded to the first semicylindrical portion 6*a* in a manner of encasing the coil 4 and core 5*a* and 5*b*, completing the holder 6 which internally holds the coil 4 and core 5*a* and 5*b*. Designated by referential symbols 4*a* and 4*b* are lead wires, which are extended outward from the holder 6 through a hole 6*c* of the front end wall of the holder 6.

Also referring to FIG. 10, the coil 4 has a roughly elliptical shape (shape of long and narrow boat), the major axis of which is parallel to the lengthwise direction of the fixation roller 1. It is disposed in the hollow of the first semicylindrical portion 6*a* of the holder 6 so that its external contour follows the internal surface of the fixation roller 1. The coil 4 must be capable of generating an alternating magnetic flux strong enough to generate a sufficient amount of heat for fixation. Therefore, the coil 4 must be small in electrical resistance, and high in inductance. As the wire for the coil 4, Litz wire is used, which is made by bundling roughly 80-160 strands of fine wire, the diameter of which is in the range of 0.1-0.3 mm. The Litz wire is wound 6-12 times around the first core 5*a*.

The core 5*a* constitutes a first core (equivalent to vertical portion of letter T) around which the Litz wire is wound. The core 5*b* constitutes a second core (equivalent to horizontal portion of letter T). The two cores 5*a* and 5*b* are attached to each other so that the resultant component will be T-shaped in cross section. As the material for the cores 5*a* and 5*b*, such a substance as ferrite that is high in permeability, and yet, is low in residual magnetic flux density, is preferable. However, the only requirement for the material for the cores 5*a* and 5*b* is that the material is capable of generating magnetic flux. In other words, what is required of the material for the cores 5*a* and 5*b* is not particularly restrictive. Further, the cores 5*a* and 5*b* are not required to be in a specific form, or be made of a specific material. Moreover, the first and second core 5*a* and 5*b* may be formed as parts of a monolithic magnetic core, which is T-shaped in cross section.

The fixing apparatus 100 is structured so that the holder 6 of the excitation coil assembly 3 is supported as shown in FIGS. 2 and 4. That is, one of the lengthwise end portions of the cylindrical holder 6 is extended outward beyond the front end of the fixation roller 1, through the front opening of the fixation roller 1, and is fitted in the hole 26*c* of the second portion 26*b* of the front supporting member 26 attached to the outward side of the front plate 21 of the fixing apparatus 100, being thereby supported by the front plate 21. The other lengthwise end portion of the holder 6 is extended outward beyond the rear end of the fixation roller 1, through the rear opening the fixation roller 1, and is fitted in the hole 27*c* of the second portion 27*b* of the rear supporting member 27 attached to the outward side of the rear plate 22 of the fixing apparatus 100, being thereby supported by the rear plate 22. More specifically, the rear end portion of the holder 6 is provided with a D-cut portion 6*d*, and the hole 27*c* of the rear supporting member 27 is D-shaped in cross section. Therefore, the holder 6 is nonrotationally supported by the front and rear plates 26 and 27 of the fixing apparatus 100. Also with the provision of the above described structural arrangement, the holder 6 is disposed in the hollow of the fixation roller 1 so that the two are coaxially disposed while providing a preset amount of gap between the peripheral surface of the holder 6 and internal surface of the fixation roller 1, and also, so that the holder 6 is nonrotationally held in a preset attitude, that is, at a preset angle in terms of its circumferential direction. The aforementioned lead wires 4*a* and 4*b* extending outward from the holder 6 through the hole 6*c*, with which the front end wall of the holder 6 is provided, are connected to an excitation circuit 51. Incidentally, regarding the means for nonrotationally holding the holder 6 at the aforementioned angle (position) in terms of its circumferential direction, in this embodiment, the D-cut end portion 6*d* of the holder 6 is fitted in the hole 27*c* of the portion 27*b* of the second supporting member 27, which is D-shaped in cross section. However, the means for nonrotationally holding the holder 6 at the preset angle (position) does not need to be limited to the above described one. That is, any means will suffice as long as the holder 6 can be nonrotationally held at the preset angle (position) in terms of its circumferential direction.

<Magnetic Flux Controlling Means>

Referring to FIG. 9, the magnetic flux controlling member 7 is shaped so that its cross section is roughly arcuate, from one lengthwise end to the other. It has a pair of shutter portions 7*a* and 7*a* (magnetic flux controlling portions) having the arcuate cross section, and a connective portion 7*b* having also the arcuate cross section. In terms of the lengthwise direction of the magnetic flux controlling member 7, the shutter portions 7*a* and 7*a* are the portions adjacent to the lengthwise ends of the magnetic flux controlling member 7, and the connective portion 7*b* is the center portion of the magnetic flux controlling member 7, which connects the shutter portions 7*a* and 7*a*. In terms of the circumferential direction of the fixation roller 1, the shutter portions 7*a* and 7*a* are wider than the connective portion 7*b*. The connective portion 7*b* is a supporting portion for supporting the arcuate shutter portions 7*a* and 7*a* (magnetic flux controlling portions) attached to, and rotatably supported by, a pair of shutter gears located at the lengthwise ends of the fixation roller assembly (magnetic flux controlling member 7). As for the material for the magnetic flux controlling member 71, such a nonferrous metallic substance as aluminum, copper, or the like is used as the material for the magnetic flux controlling member 7, and among nonferrous metallic substances, those which are lower in electrical resistance are preferable. The magnetic flux controlling member 7 is also provided with a pair of protrusions 7*c* and 7*c*, which protrude from the outward edges of the shutter portions 7*a* and 7*a*, one for one, in the lengthwise direction of the magnetic flux controlling member 7. These protrusions 7*c* and 7*c* are engaged with the first and second shutter gears G2 and G3*c* rotatably fitted around the front and rear end portions of the holder 6 (FIGS. 8 and 9). With the provision of the above described structural arrangement, the magnetic flux controlling member 7 is held at its lengthwise ends by the first and second shutter gears G2 and G3, between the first and second shutter gears G2 and G3. Thus, as the first and second gears G2 and G3 are rotated by the magnetic flux controlling member moving means M2, 28, G4, and G5, the magnetic flux controlling member 7 is rotated within the hollow of the fixation roller 1, more specifically, within the cylindrical gap between the external surface of the holder 6 and the internal surface of the fixation roller 1, in the circumferential direction of the fixation roller 1 (holder 6), with the rotational axis of the magnetic flux controlling member 7 coinciding with that of the holder 6.

Referring to FIG. 8 which depicts the means M2, 28, G4, and G5 for moving the magnetic flux controlling member 7, a referential symbol M2 stands for a second motor; 28: a shaft; G4: first output gear; and a referential symbol G5 stands for a second output gear. The shaft 28, which is located outside the fixation roller 1, is rotatably supported in parallel to the fixation roller 1, by the front and rear plates 21 and 22 of the fixing apparatus 100, with a pair of bearings (unshown) placed between the shaft 28 and the plates 21 and 22. The second motor M2 is a driving force source for rotating the shaft 28, and is a stepping motor. The first and second output gears G4 and G5 are rigidly attached to the shaft 28 so that they are coaxial with the shaft 28. The first and second output gears G4 and G5 are meshed with the first and second shutter gears G2 and G3 of the excitation coil assembly 3, respectively. Thus, as the second motor M2 is rotationally driven, the rotational force is transmitted to the first and second shutter gears G2 and G3, causing thereby the magnetic flux controlling member 7 to rotate about the axial line of the holder 6 in a manner to follow the peripheral surface of the holder 6. As for the material for the gears, one of the various resinous substances may be selected according to the ambient temperature, and the amount of torque to which they are subjected.

Referring to FIG. 2, designated by a referential symbol 50 is a control circuit portion (CPU) as a controlling means, which activates the first motor M1 with a preset control timing, through a driver 52, according to an image formation sequence. As the first motor M1 is activated, the rotational force is given to the driving gear G1 of the fixation roller 1, rotationally driving the fixation roller 1 in the clockwise direction indicated by an arrow mark in FIG. 3, within a preset range. The pressure roller 2 is rotated by the rotation of the fixation roller 1.

The control circuit portion 50 also activates the excitation circuit 51 with a preset timing, supplying thereby the coil 4 with alternating electric current. As a result, an alternating magnetic flux (alternating magnetic field) is generated, and therefore, heat is generated in the wall of the fixation roller 1 by electromagnetic induction, causing the fixation roller 1 to increase in temperature.

Figure 6:
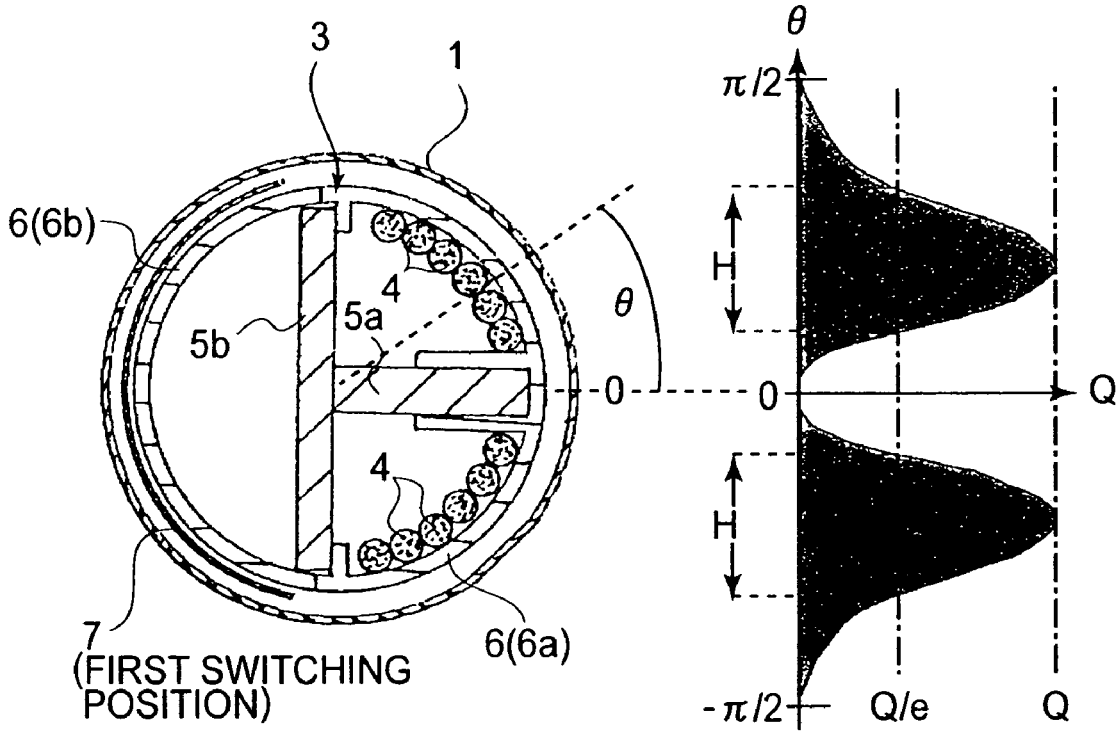
FIG. 6 is a schematic drawing showing the area in which the major portion of the magnetic flux is generated, and the distribution of the heat generated in the portion of the fixation roller which corresponds in position to the area.

FIG. 6 is the combination of a schematic cross-sectional view of the fixation roller 1 in the system such as the above described one, and a graph showing the heat distribution of the fixation roller 1 in the heated condition. It shows the areas to which the major portion of the magnetic flux generated by the magnetic flux generating means concentrates, and the corresponding heat distribution of the fixation roller 1, in terms of the circumferential direction of the fixation roller 1. As alternating electric current is flowed through the coil 4, the coil 4 generates an alternating magnetic flux. The fixation roller 1 is formed of a magnetic metal or nonmetallic magnetic substance as described above. Within the wall of the fixation roller 1, eddy current is induced in a manner to neutralize the magnetic field. This eddy current generates heat (Joule heat) in the wall of the fixation roller 1, increasing thereby the fixation roller 1 in temperature.

In the case of the structure of the fixing apparatus in this embodiment, the area in which major portion of the magnetic flux is generated is on the outward side of the first semicylindrical portion 6*a* of the holder 6, in which the coil 4 and cores 5*a* and 5*b* are disposed. Thus, the portion of the fixation roller 1, which is in this area, is where heat is generated by the magnetic flux. The heat distribution of the fixation roller 1, in terms of the circumferential direction of the fixation roller 1, across the portion in the abovementioned magnetic flux generation area, has two areas H and H, in which most of the heat is generated, as shown by the schematic drawing and graph in FIG. 6. In this embodiment, the holder 6 is nonrotationally held (positioned) at such an angle in terms of the circumferential direction of the holder 6 that the portion of the coil 4, which corresponds to one of the two areas H and H, faces the fixation nip N, and the portion of the coil 4, which corresponds to the other of the two areas H and H, faces the immediate adjacencies of the fixation nip N on the upstream side in terms of the rotational direction of the fixation roller 1.

When the magnetic flux controlling member 7, which is in the gap between the peripheral surface of the holder 6 and the internal surface of the fixation roller 1, is not required to adjust the magnetic flux, it is moved into, and kept in, the position shown in FIGS. 3 and 6, which is on the opposite side of the fixing apparatus from the aforementioned areas in which the major portion of the magnetic flux is generated. This area in which the magnetic flux controlling member 7 is kept when the magnetic flux controlling member 7 is not required to adjust the magnetic flux is where the magnetic flux from the magnetic flux generating means is virtually nonexistent, or extremely low in density. This position shown in FIGS. 3 and 6, in which the magnetic flux controlling member 7 is kept when the magnetic flux controlling member 7 is not required to adjust the magnetic flux, will be referred to as first position.

The temperature of the fixation roller 1 is detected by a central thermistor TH1 as a temperature detecting means, disposed at the roughly mid point of the fixation roller 1 in terms of the lengthwise direction thereof, in contact, or with no contact, with the fixation roller 1, and the detected temperature is inputted into the control circuit 50, which controls the temperature of the fixation roller 1 by controlling the electric power supplied from the excitation circuit 51 to the coil 4, so that the fixation roller temperature detected by the central thermistor TH1 and inputted into the control circuit 50 remains at a preset target temperature (fixation temperature). While the magnetic flux controlling member 7 is kept in the first position shown in FIGS. 3 and 6, the fixation roller 1 is controlled in temperature so that the temperature of the fixation roller 1 is kept at the target level across the entirety of its effective range (heatable range) in terms of its lengthwise direction.

While the fixation roller temperature is kept at the preset fixation level after being raised thereto, a recording medium P bearing an unfixed toner image t is introduced into the fixation nip N, and is conveyed through the fixation nip N while being kept pinched by the fixation roller 1 and pressure roller 2. As the recording medium P is conveyed through the fixation nip N, the unfixed toner image t on the recording medium P is fixed to the surface of the recording medium P by the heat from the fixation roller 1 and the pressure in the fixation nip N.

Hereinafter, the term, recording medium width, means the dimension of a recording medium, in terms of the direction perpendicular to the recording medium conveyance direction a, when the recording medium P is completely flat. As described above, in this embodiment, the recording medium P is conveyed through the fixing apparatus (image forming apparatus) so that the center of the recording medium P in terms of its width direction coincides with the center of the fixing apparatus (fixation roller 1) in terms of the width direction of the recording medium P. Referring to FIGS. 2 and 4, designated by a referential symbol O is the centerline (hypothetical line), as the referential line, of the fixation roller 1 (recording medium) in terms of its lengthwise direction, and designated by a referential symbol A is the width of the path of the largest recording medium, in terms of width, usable with the image forming apparatus. Designated by a referential symbol B is the width of the path of a recording medium which is one size smaller than the largest recording medium. Hereinafter, a recording medium smaller in width than the largest recording medium will be referred to simply as recording medium of the small size. Designated by a referential symbol C are the areas between the edges of a large recording medium and the edge of a recording medium of the small size. In other words, each of the areas C is the portion of the recording medium passage, which does not come into contact with a recording medium of the small size when the recording medium the small size is conveyed through the fixing apparatus. Since a recording medium is conveyed through the fixing apparatus so that the center of the recording medium in terms of its width direction coincides with the center of the fixation roller 1 in terms of its lengthwise direction, there will be two areas C, one on the left side of the path B of a recording medium of the small size, and the other on the right side of the path B of a recording medium of the small size. The width of the areas C is changed by the width of the recording medium being conveyed through the fixing apparatus (image forming apparatus).

The abovementioned central thermistor TH1 used for controlling the temperature of the fixation roller 1 is disposed within the path B of a recording medium of the small size so that it will be within the path of a recording medium regardless of recording medium width.

Designated by a referential symbol TH2 is a peripheral thermistor as a temperature detecting means disposed within one of the areas C, that is, the areas outside the path of a recording medium, in terms of the lengthwise direction of the fixation roller 1, in contact, or with no contact, with the fixation roller 1, in order to monitor the increase in the temperature of the fixation roller 1, across the portions corresponding to the out-of-path areas C. The temperature data obtained by this peripheral thermistor TH2 are also inputted into the control circuit portion 50.

As multiple recording mediums of the small size are consecutively conveyed through the fixing apparatus 100, the portions of the fixation roller 1 corresponding in position to the out-of-path areas C increases in temperature, and this increase in temperature is detected by the peripheral thermistor TH2, and the detected increase in temperature is inputted from the thermistor TH2 to the control circuit portion 50. As the temperature level of the out-of-path area C inputted into the control circuit portion 50 by the peripheral thermistor TH2 exceeds the preset permissible range, the control circuit portion 50 rotates the magnetic flux controlling member 7 from the first position shown in FIGS. 3 and 6 into the second position shown in FIG. 5 by activating the second motor M2 through the driver 53.

The second position for the magnetic flux controlling member 7 is such a position that when the magnetic flux controlling member 7 is in this position, the arcuate shutter portions 7*a* and 7*a*, that is, the virtual end portions of the magnetic flux controlling member 7 in its lengthwise direction, which are wider, in terms of the circumferential direction of the fixation roller 1, than the connective portion 7*b*, that is, the center portion of the magnetic flux controlling member 7, are in the following positions. That is, the arcuate shutter portions 7*a* and 7*a* of the magnetic flux controlling member 7 which is in the gap between the peripheral surface of the holder 6 and the internal surface of the fixation roller 1, are placed in the portions of the above described portions of the gap, one for one, which correspond in position to the out-of-path areas C in terms of the lengthwise direction of the fixation roller 1, and also, to the area in which the magnetic flux is generated, in terms of the circumferential direction of the fixation roller 1.

With the magnetic flux controlling member 7 placed in the second position, the magnetic flux from the magnetic flux generating means is reduced in the amount by which it acts on the portion of the fixation roller 1 which corresponds in position to the out-of-path areas C and C. Therefore, the portions of the fixation roller 1 corresponding to the out-of-path areas C are minimized in the amount by which heat is generated therein. Therefore, the problem that the portions of the fixation roller 1 corresponding to the out-of-path areas C increase in temperature is prevented.

Figure 5:
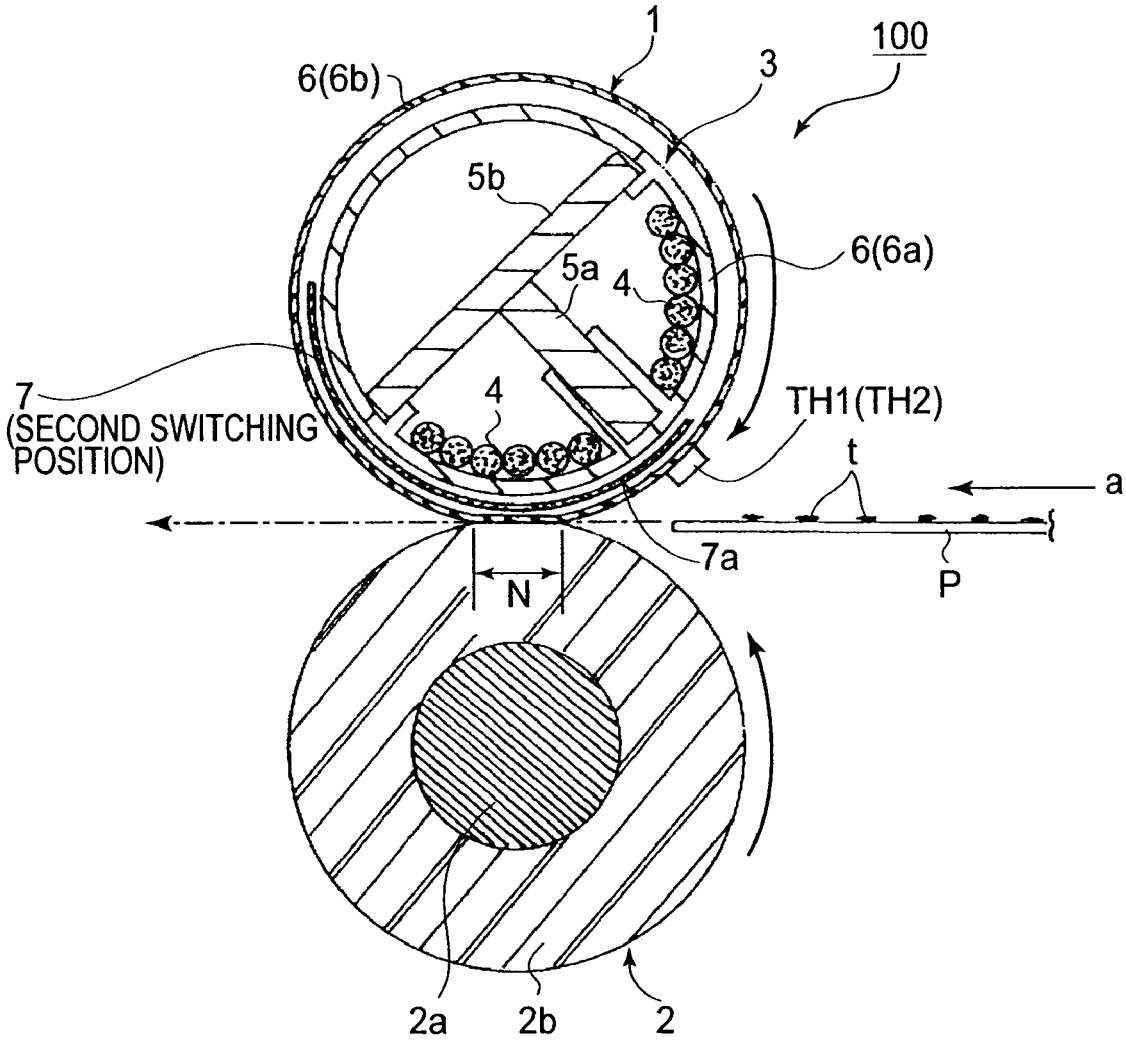
FIG. 5 is an enlarged cross-sectional view of the essential portions of the fixing apparatus, the magnetic flux adjusting member of which is being rotated into the second magnetic flux adjusting position.

It is possible to structure the fixing apparatus 100 so that as the magnetic flux controlling member 7, which is in the gap between the peripheral surface of the holder 6 and the internal surface of the fixation roller 1, is moved into the aforementioned second position, the shutter portions 7*a* and 7*a*, which correspond in position to the out-of-path areas C and C, extend from one end of the magnetic flux generation area, in terms of the circumferential direction of the fixation roller 1 (holder 6), to the other, or a part of the way to the other. FIG. 5 shows the structural arrangement in which the shutter portions 7*a* and 7*a* extend from one end of the magnetic flux generation area halfway to the other.

As the magnetic flux controlling member 7 is rotationally moved into the second position, the portions of the fixation roller 1 corresponding to the out-of-path areas C gradually reduce in temperature. As the temperature level of these portions inputted into the control circuit portion 50 by the peripheral thermistor TH2 falls below the predetermined permissible level, the control circuit portion 50 rotationally moves the magnetic flux controlling member 7 into the first position to prevent these portions of the fixation roller 1 from becoming too low in temperature.

Further, if an image forming operation which uses recording mediums of a small size is switched to an image forming operation which uses recording mediums of a large size after the magnetic flux controlling member 7 is moved into the second position during the image forming apparatus using the recording mediums of the small size, the control circuit portion 50 rotates the magnetic flux controlling member 7 back into the first position.

As one of the methods for securing a proper amount of gap between the fixation roller 1 and magnetic flux controlling member 7, there is the method which widens the distance between the magnetic flux controlling member 7 and fixation roller 1. However, this method suffers from the following problem. That is, as the distance between the magnetic flux controlling member 7 and fixation roller 1 is increased, the distance between the core 5 and fixation roller 1 increases, and if the distance between the core 5 and fixation roller 1 is increased beyond a certain value, heat exchange efficiency drastically drops. Therefore, currently, this method is seldom used. The holder 6 is extended, in terms of the circumferential direction of the fixation roller 1, to the opposite side of the fixation roller 1 from where the coil 4 is disposed, making the holder 6 roughly circular in cross section, from one lengthwise end to the other. Shaping the holder 6 as described above makes it possible to make the rotational axes of the holder 6, fixation roller 1, and magnetic flux controlling member 7 coincide, making it therefore possible to improve the fixing apparatus 100 in terms of the accuracy with which these components are positioned relative to each other.

As for the means for transmitting the force for driving the magnetic flux controlling member 7, the front and rear lengthwise end portions of the holder 6 are fitted with the first and second shutter gears G2 and G3, respectively, which are rotatable around the holder 6, as described above. Further, the magnetic flux controlling member 7 is provided with the aforementioned protrusions 7*c*, which protrude outward from the outward edges of the magnetic flux controlling member 7. These protrusions 7*c* are engaged with the first and second shutter gears G2 and G3 so that the magnetic flux controlling member 7 is supported at both of its lengthwise ends, between the gears G2 and G3, by the gears G2 and G3. The shutter gears G2 and G3 are engaged with (fitted around) the holder 6 by the portions which are not engaged with the protrusions 7*c* and 7*c* of the magnetic flux controlling member 7. Therefore, the magnetic flux controlling member 7 can be rotated by the gears G2 and G3, following the peripheral surface of the holder 6. The portion of the holder 6, around which the gear G2 is fitted, and the portion of the holder 6, around which the gear G3 is fitted, are rendered uniform in external diameter across the portions largest in external diameter. Here, the expression that the portions of the holder 6, around which the gears G2 and G3 are fitted, one for one, and are the largest in external diameter, means that these portions may be provided with ribs so that these portions are rendered uniform in the external diameter inclusive of the ribs. With the employment of this structural arrangement, as the holder 6 and magnetic flux controlling member 7 are engaged with the gears G2 and G3, they are coaxially disposed, making it possible to improve the image heating apparatus in terms of the level of accuracy at which these components are positioned relative to each other.

Basically, the magnetic flux controlling member 7 is arcuate in cross section from one lengthwise end to the other in terms of the lengthwise direction of the fixation roller 1. The lengthwise end portions of the magnetic flux controlling member 7 are different in dimension (in terms of circumferential direction of fixation roller 1: arc length in cross-sectional view) from the center portion of the magnetic flux controlling member 7. When a recording medium of a small size is conveyed through the fixing apparatus, the magnetic flux controlling member 7 is rotated so that the shutter portions 7*a* and 7*a*, that is, the lengthwise portions, of the magnetic flux controlling member 7 are moved into the areas where the magnetic flux is generated, in order to prevent the fixation roller 1 from increasing in temperature across the lengthwise end portions. In this embodiment, the magnetic flux is controlled by moving the shutter portions 7*a* and 7*a*, that is, the magnetic flux blocking portions of the magnetic flux controlling member 7, into the out-of-path areas of the magnetic flux generation area. However, this is not the only method to control a magnetic flux. For example, the following method is possible. That is, the magnetic flux controlling member 7 is shaped so that the center portion of the magnetic flux controlling member 7 constitutes the magnetic flux controlling portion (shutter portion) which corresponds in position to the recording medium passage in terms of the lengthwise direction of the fixing apparatus, and this shutter portion is moved into the magnetic flux generation area to change the magnetic flux in the distribution across the area which corresponds to the recording medium passage. In other words, the temperature of the fixation roller 1 may be adjusted by changing the area corresponding to the recording medium path, and the areas corresponding to the areas outside the recording medium path, in the distribution of the amount by which heat is generated, in terms of the lengthwise direction of the fixation roller 1.

(Method for Driving Magnetic Flux Controlling Member)

Figure 11:
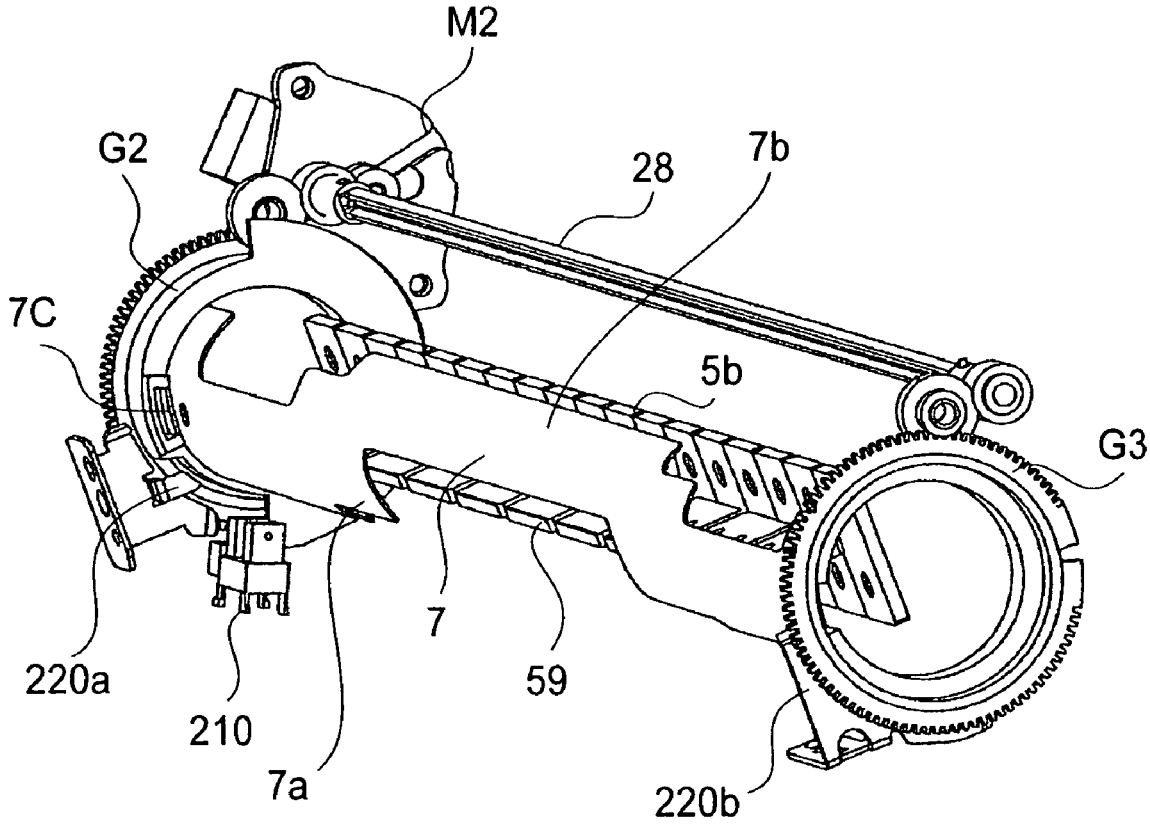
FIG. 11 is a perspective drawing showing the regulating portion for regulating the movement of the magnetic flux controlling member, and the driving gear for driving the magnetic flux controlling member.
Figure 12:
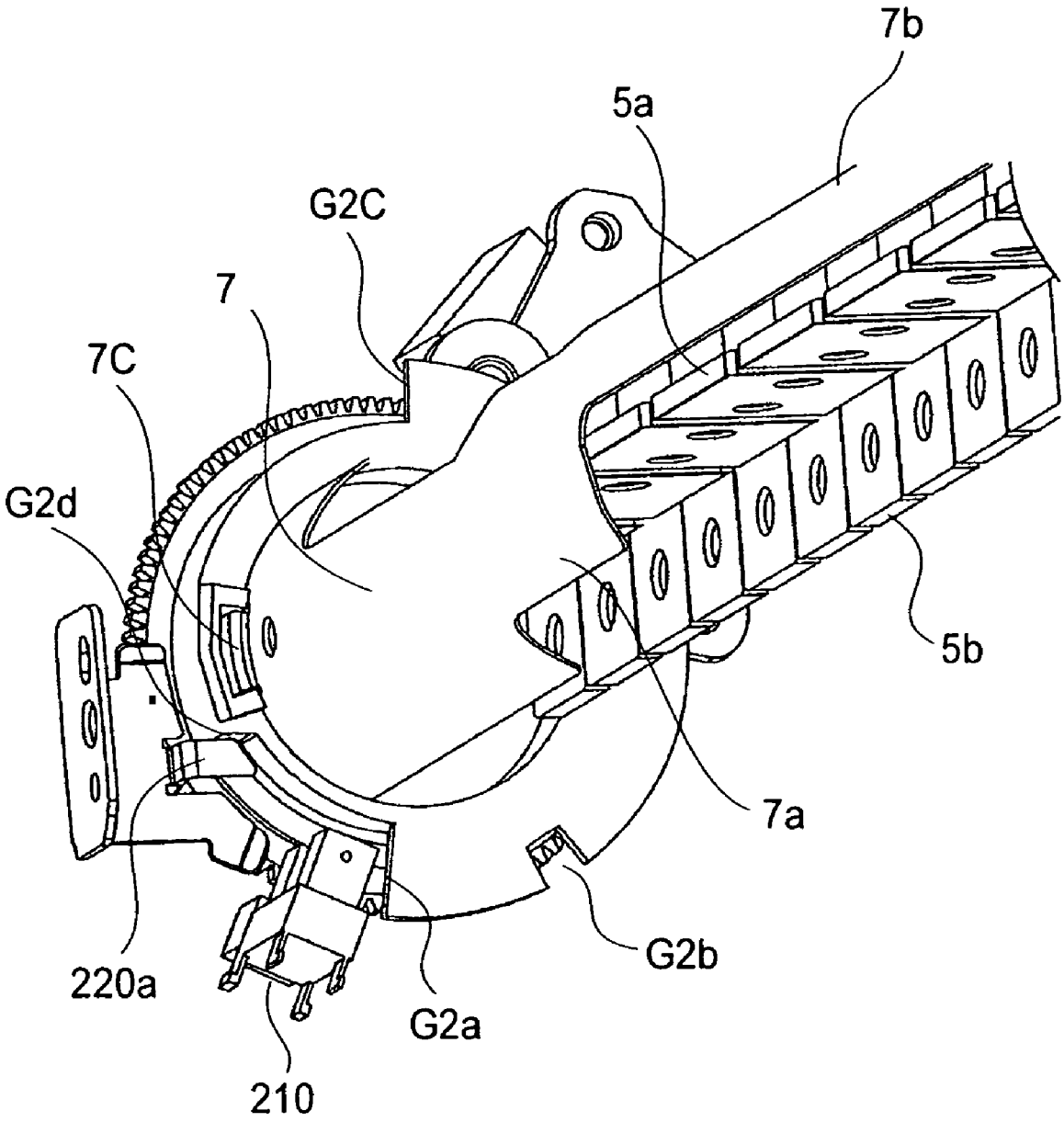
FIG. 12 is an enlarged view of the regulating portion for regulating the movement of the magnetic flux controlling member, and the driving gear for driving the magnetic flux controlling member.

Next, referring to FIGS. 11 and 12, the method for driving the magnetic flux controlling member 7 will be described. FIG. 11 is a perspective drawing showing the mechanism for driving the magnetic flux controlling member 7 in this embodiment. The magnetic flux controlling member 7 in this drawing is such a magnetic flux controlling member that is provided with three kinds of magnetic flux controlling portions, being enabled to deal with three kinds of recording mediums different in width. FIG. 12 is an enlarged perspective view of the means for driving the magnetic flux controlling member 7, depicting the regulating portion for regulating the movement of the magnetic flux controlling member 7 in this embodiment. For the purpose of simplifying the description, some of the components of the magnetic flux controlling member driving mechanism are not shown in FIGS. 11 and 12.

The magnetic flux controlling member driving mechanism is provided with a magnetic flux controlling member driving gear G2 as a first driving force transmitting means (first driving force moving means), which is disposed on the front side of the image forming apparatus, and a magnetic flux member driving gear G3 as a second driving force transmitting means, which is disposed on the rear side of the image forming apparatus.

The magnetic flux controlling member 7 is provided with a pair of protrusions 7*c*, which protrude from the lengthwise outward edges of the magnetic flux controlling member 7. The protrusions 7*c* are engaged with the aforementioned gears G2 and G3 as the first and second driving force transmitting means, one for one.

The gears G2 and G3 as the first and second driving force transmitting means are fitted around the holder 6, with the internal surface of each gear being in contact with the peripheral surface of the holder 6, except for where the corresponding protrusion 7*c* is in engagement with the gear.

With the provision of this structural arrangement, the magnetic flux controlling member 7 is supported in such a manner that when the magnetic flux controlling member 7 is rotated by the rotation of the gears G2 and G3, it remains supported by the peripheral surface of the holder 6. Therefore, the holder 6 is not locally worn by friction.

The shaft 28 as a third driving force transmitting means, which is the means for distributing the driving force between the abovementioned gears G2 and G3, is disposed in parallel to the fixation roller 1.

As the means used, in this embodiment, for generating the force for driving the magnetic flux blocking member, is the stepping motor M2.

The driving force outputted from the stepping motor M2 is transmitted to the shaft 28 through the output gear. Then, it is transmitted to the magnetic flux controlling means 7, from both the front and rear end sides thereof, through the first and second magnetic flux controlling means driving gears G2 and G3.

The magnetic flux controlling member driving gear G2 is provided with first, second, and third notches G2*a*, G2*b*, and G2*c*, respectively.

The rotation of the magnetic flux controlling member driving gear G2 is controlled in response to the ON or OFF signal outputted by a position sensor 210, as the first, second, and third notches G2*a*, G2*b*, or G2*c* of the gear G2 moves past the position sensor 210. The positions of the first, second, and third notches G2*a*, G2*b*, and G2*c* relative to the magnetic flux controlling member 7 in terms of the rotational direction of the magnetic flux controlling member 7 (gear G2) correspond to the positions in which the magnetic flux controlling member 7 is placed to shield the fixation roller 1 from the magnetic flux, across the portions outside the recording medium path, according to the size of a recording medium.

FIG. 12 is a drawing of the magnetic flux controlling member driving mechanism in the state in which the position sensor 210 has failed to detect the notches G2*a*, G2*b*, and G2*c* of the magnetic flux controlling member driving gear G2. In such a case, the magnetic flux controlling member driving gear G2 is allowed to continue to be rotated, because the position of the gear G2 in terms of the rotational direction thereof has not been detected. Thus, the fixing apparatus is provided with a regulating member which prevents the magnetic flux controlling means from moving past a preset range. More specifically, the magnetic flux controlling member driving gear G2 is provided with a rotation regulating portion G2*d* as the portion for regulating the movement (rotation) of the magnetic flux controlling means driving gear G2, and the movement (rotation) of the magnetic flux controlling member is regulated (stopped) as the rotating regulating portion G2*d* comes into contact with the rotation regulating portion 220*a* of a rotation regulating member 220. That is, as the rotation regulating portion G2*d* comes into contact with the rotation regulating portion 220*a*, the stepping motor M2 becomes overloaded, becoming thereby asynchronous. As a result, the motor stops rotating. On the rear side of the fixing apparatus, the gear G3 is provided with a rotation regulating portion G3*d*, and the rotation regulating portion 220 with a rotation regulating portion 220*b*. The rotation of the magnetic flux controlling member driving gear G3 is regulated at the same time as the rotation of the magnetic flux controlling member driving gear G2 is regulated. Referring to FIG. 12, even after the magnetic flux controlling member 7 is rotated as far as it can be rotated, the lengthwise center portion of the first core 5*a* is not covered with the magnetic flux controlling member 7. That is, the magnetic flux controlling member 7 is prevented from being moved into the position in which the connective portion 7*a* of the magnetic flux controlling member 7 covers the first core 5*a*. In this embodiment, the magnetic flux controlling portions 7*a* and connective plate portion 7*b* (connective portion), which are arcuate in cross section, are generally the same in material, and are formed of such a nonferrous metallic substance as aluminum, copper, or the like, for example. Among the nonferrous metallic substances, those which are low in electrical resistivity are preferred.

Here, the magnetic flux controlling positions for the magnetic flux controlling member is such positions that when the magnetic flux controlling member is in one of the controlling positions, the magnetic flux controlling portions of the magnetic flux controlling member 7 oppose the center of the coil (center of outward end of first core in terms of radius direction of holder), that is, where the magnetic flux generated toward the heating member from the coil is densest.

As described above, the rotation controlling member 220*a* and rotation regulating portion G2*d* are positioned so that even when the magnetic flux controlling member 7 is in the farthest position into which it can be rotated, it does not cover the entirety of the first core 5*a* in terms of the lengthwise direction of the first core 5*a*.

Although not shown in the drawings, the magnetic flux controlling member driving gear G2 is also provided with a rotation regulating portion similar to the rotation regulating portion G2*d*. Thus, the rotation of the magnetic flux controlling member driving gear G2 is regulated to prevent the first core 5*a* from being entirely covered by the magnetic flux controlling member 7 in terms of the lengthwise direction of the first core 5*a*, also when the gear G2 is rotated toward the third notch G2*c*.

With the provision of the above described structural arrangement, it does not occur that the end surface of the first core 5*a*, in terms of the radius direction of the holder 6, around which the magnetic flux concentrates, is entirely covered with the magnetic flux controlling member in terms of the lengthwise direction of the first core 5*a*. Therefore, it does not occur that the magnetic flux controlling member 7 and/or coil 4 abnormally increases in temperature. Further, it does not occur that the electric power source is damaged by the sudden decreases in the impedance L of the coil 4.

Incidentally, in this embodiment, the rotation regulating members are located at both lengthwise ends of the magnetic flux controlling member. However, this embodiment is not intended to limit the scope of the present invention. For example, the regulating member(s) may be located at only one of the lengthwise ends, or the center, of the magnetic flux controlling member. When placing the regulating member at only one of the lengthwise ends of the magnetic flux controlling member, the lengthwise end of the magnetic flux controlling member at which the regulating member is placed is desired to be the same lengthwise end as where the driving force generating means (driving power source) for moving the magnetic flux controlling member is disposed. With the employment of this structural arrangement, it is possible to minimize the amount by which the magnetic flux controlling member is twisted when its movement is regulated by the regulating member.

(3) Miscellanies

Figure 13:
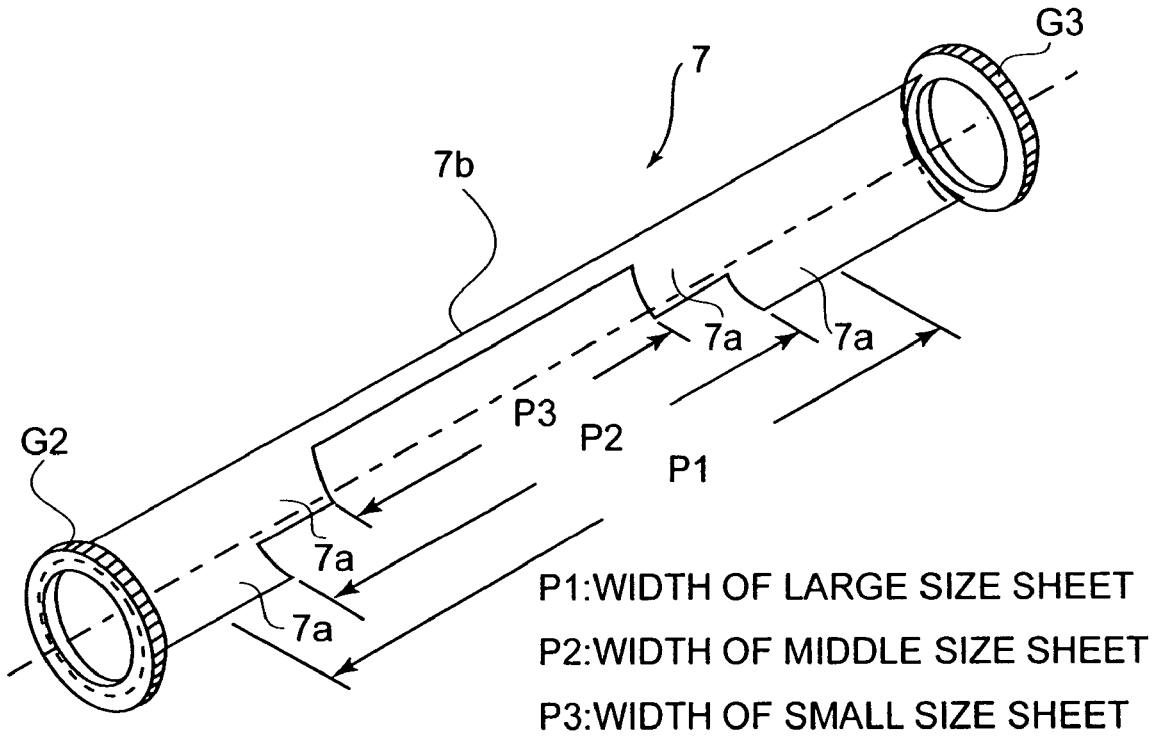
FIG. 13 is a schematic perspective view of the magnetic flux adjusting member given a shape that enables it to deal with three recording medium sheet sizes.

1) The apparatus in this embodiment was provided with the first and second magnetic flux controlling positions into which the magnetic flux controlling member 7 can be moved into, and which corresponds to the large or small size of recording medium. However, this embodiment is not intended to limit the scope of the present invention. Obviously, the apparatus may be provided with three or more magnetic flux controlling positions into which the magnetic flux controlling member 7 can be moved, and which corresponds to three or more recording medium widths, respectively. FIG. 13 is a schematic perspective view of the magnetic flux controlling member 7 enabled to deal with three recording medium sheet sizes: large, medium, and small.

Figure 14:
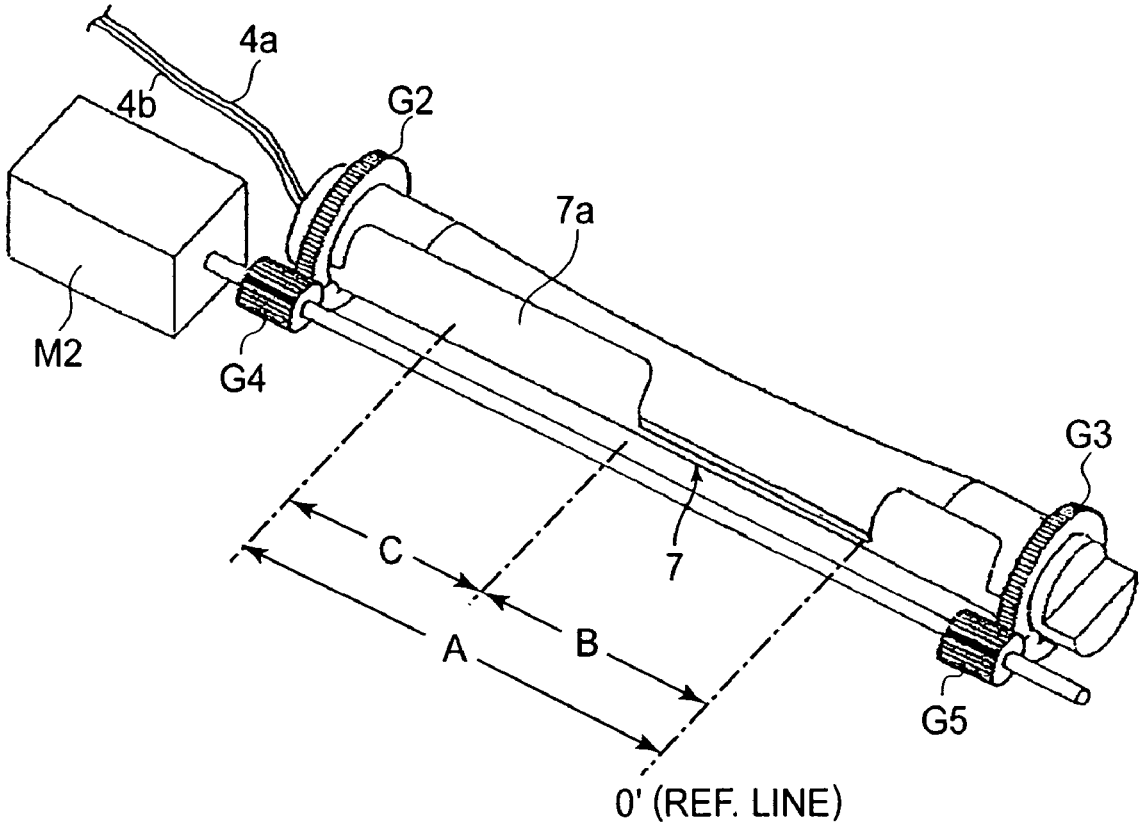
FIG. 14 is a schematic perspective view of the magnetic flux controlling member driving mechanism for an image forming apparatus structured so that when a sheet of recording medium is conveyed through it, one of the lateral edges of the sheet of recording medium is kept aligned with the recording medium conveyance referential line of the apparatus.
Figure 15:
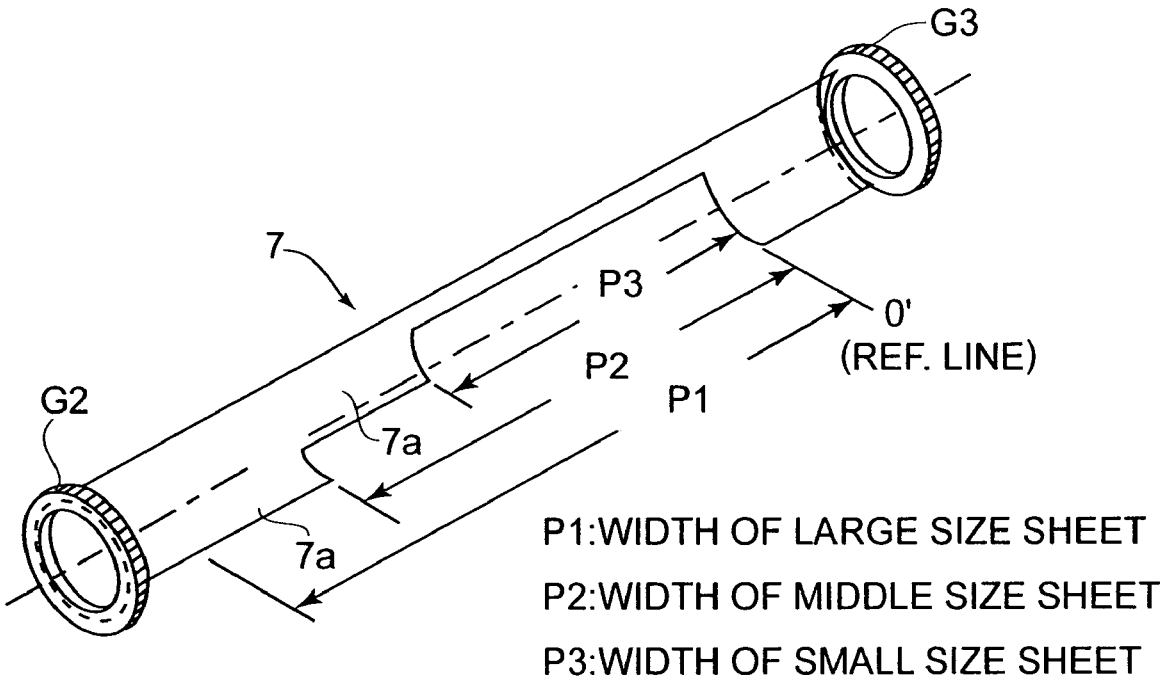
FIG. 15 is a schematic perspective view of another magnetic flux controlling member driving mechanism for an image forming apparatus structured so that when a sheet of recording medium is conveyed through it, one of the lateral edges of the sheet of recording medium is kept aligned with the recording medium conveyance referential line of the apparatus.

2) The apparatus in this embodiment is structured so that when a sheet of recording medium is conveyed through the apparatus, the center of the recording medium in terms of the direction perpendicular to the recording medium conveyance direction coincides with the lengthwise center of the heating member (fixation roller). However, the present invention is also effectively applicable to an apparatus structured so that when a sheet of recording medium is conveyed through the apparatus, one of the lateral edges of the sheet of recording medium is kept aligned with the recording medium conveyance referential line (edge, rib, or the like) with which the apparatus is provided. FIGS. 14 and 15 show the magnetic flux controlling member driving mechanism and the magnetic flux controlling member, respectively, in an apparatus in which one of the lateral edges of a sheet of recording medium is aligned with the recording medium conveyance referential line (edge, rib, or the like) with which the apparatus is provided. The line designated by a referential symbol O' in FIG. 14 is the referential line.

3) The usage of an inductive image heating apparatus in accordance with the present invention is not limited to the usage as the image heating apparatus in this embodiment. That is, an inductive image heating apparatus in accordance with the present invention is also effectively usable as such an image heating apparatus as a fixing apparatus for temporarily fixing an unfixed image to recording medium, or a surface property changing apparatus for reheating a sheet of recording medium bearing a fixed image, along with the fixed image, to change the sheet of recording medium and the fixed image thereon in surface properties such as glossiness. Moreover, it is effectively usable as such an image heating apparatus for heating an object in the form of a sheet, as a thermal pressing apparatus for removing the wrinkles from an object in the form of a sheet, or a thermal drying apparatus for evaporating the water content from an object containing water, which is obvious.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No. 307530/2004 filed Oct. 22, 2004, which is hereby incorporated by reference.

What is claimed is:

1. An image heating device comprising:

magnetic flux generating means;

a heat generating member for generating heat by a magnetic flux from said magnetic flux generating means to heat an image on a recording material;

a magnetic flux confining member for confining the magnetic flux directed toward said heat generating member from said magnetic flux generating means;

moving means for moving said magnetic flux confining member to a magnetic flux confining position from a retracted position where said magnetic flux confining member is retracted from said magnetic flux confining position;

stop means for stopping said magnetic flux confining member at said magnetic flux confining position;

a moving portion which moves in interrelation with movement of said magnetic flux confining member from said retracted position toward said magnetic flux confining position; and a preventing member, disposed downstream of said magnetic flux confining position with respect to a moving direction of said magnetic flux confining member from said retracted position toward said magnetic flux confining position, for contacting said moving portion to prevent movement of said magnetic flux confining position.

2. A device according to claim 1, wherein said magnetic flux generating means includes an excitation coil wound generally in a direction parallel with a rotation axis of said heat generating member, and wherein the magnetic flux confining position is between a coil winding center and said heat generating member.

3. A device according to claim 2, wherein said magnetic flux generating means is wound around said excitation coil and includes a magnetic core for directing the magnetic flux from said excitation coil toward said heat generating member, and wherein said magnetic flux confining position is in a gap between said magnetic core and said heat generating member.

4. A device according to claim 2, further comprising a temperature detecting means for detecting a temperature of said heat generating element and electric power supplying means for supplying electric power to said coil on the basis of an output of said temperature detecting means.

5. A device according to claim 1, wherein said apparatus includes a plurality of such preventing members, and said preventing members prevent the movement of said magnetic flux confining portion at opposite ends of said magnetic flux confining member with respect to a rotation axial direction of said heat generating member respectively.

6. A device according to claim 1, wherein said magnetic flux confining member is rotatably supported and is extended along a circumference of said heat generating member, and said preventing member prevents said magnetic flux confining member from moving beyond said magnetic flux confining position.

7. A device according to claim 1, wherein said moving means includes a drive transmission member for transmitting a driving force to said magnetic flux confining member.

8. A device according to claim 1, wherein said preventing member is contactable to said moving means to prevent said magnetic flux confining member from moving in the moving direction from said retracted position toward said magnetic flux confining position.

9. An image heating device comprising:

magnetic flux generating means;

a heat generating member for generating heat by a magnetic flux from said magnetic flux generating means to heat an image on a recording material;

magnetic flux confining means for confining the magnetic flux directed toward said heat generating member from said magnetic flux generating means, said magnetic flux confining means including a magnetic flux confining portion for confining the magnetic flux directed toward a predetermined region of said heat generating member at a predetermined magnetic flux confining position;

moving means for moving said magnetic flux confining portion to a magnetic flux confining position from a retracted position where said magnetic flux confining portion is retracted from said magnetic flux confining position;

stop means for stopping said magnetic flux confining member at said magnetic flux confining position;

a moving portion which moves in interrelation with movement of said magnetic flux confining portion from said retracted position toward said magnetic flux confining position;

a preventing member, disposed downstream of said magnetic flux confining position with respect to a moving direction of said magnetic flux confining member from said retracted position toward said magnetic flux confining position, for contacting said moving portion to prevent movement of said magnetic flux confining position.

10. A device according to claim 9, wherein said magnetic flux generating means includes an excitation coil wound generally in a direction parallel with a rotation axis of said heat generating member, and wherein the magnetic flux confining position is between a coil winding center and said heat generating member.

11. A device according to claim 10, wherein said magnetic flux generating means is wound around said excitation coil and includes a magnetic core for directing the magnetic flux from said excitation coil toward said heat generating member, and wherein said magnetic flux confining position is in a gap between said magnetic core and said heat generating member.

12. A device according to claim 10, further comprising a temperature detecting means for detecting a temperature of said heat generating member and electric power supplying means for supplying electric power to said coil on the basis of an output of said temperature detecting means.

13. A device according to claim 9, wherein said apparatus includes a plurality of such preventing members, and said preventing members prevent the movement of said magnetic flux confining portion at opposite ends of said magnetic flux confining means with respect to a rotation axial direction of said heat generating member respectively.

14. A device according to claim 9, wherein said magnetic flux confining means is rotatably supported and is extended along a circumference of said heat generating member, and said preventing member prevents said magnetic flux confining means from moving beyond said magnetic flux confining position.

15. A device according to claim 9, wherein said moving means includes a drive transmission member for transmitting a driving force to said magnetic flux confining member, and said movable member is provided on said drive transmission member.

16. A device according to claim 9, wherein said moving means is capable of moving said magnetic flux confining member from said magnetic flux confining position to said retracted position.

17. A device according to claim 16, further comprising a second moving portion movable in interrelation with movement of said magnetic flux confining member from said retracted position toward said magnetic flux confining position, wherein when said moving means moves said magnetic flux confining member beyond a predetermined position in a direction opposite the moving direction, the movement of said magnetic flux confining member is prevented by contact between said second moving portion and said preventing member.

* * * * *

UNITED STATES PATENT AND TRADEMARK OFFICE

CERTIFICATE OF CORRECTION

PATENT NO. : 7,348,524 B2
APPLICATION NO. : 11/255149
DATED : March 25, 2008
INVENTOR(S) : Takematsu et al.

It is certified that error appears in the above-identified patent and that said Letters Patent is hereby corrected as shown below:

COLUMN 1:
Line 23, “erated” should read --erated by--.

COLUMN 2:
Line 59, “rotation” should read --rotation of--.
Line 63, “a-predetermined” should read --a predetermined--.

COLUMN 6:
Line 32, “above described” should read --above-described--.
Line 48, “abovementioned” should read --above-mentioned--.

COLUMN 8:
Line 12, “above described” should read --above-described--.
Line 30, “above described” should read --above-described--.

COLUMN 9:
Line 1, “above described” should read --above-described--.
Line 57, “above” should read --above- --.

COLUMN 11:
Line 29, “medium” should read --medium of--.
Line 41, “abovementioned” should read --above-mentioned--.

COLUMN 12:
Line 15, “above described” should read --above-described--.

UNITED STATES PATENT AND TRADEMARK OFFICE

CERTIFICATE OF CORRECTION

PATENT NO. : 7,348,524 B2
APPLICATION NO. : 11/255149
DATED : March 25, 2008
INVENTOR(S) : Takematsu et al.

It is certified that error appears in the above-identified patent and that said Letters Patent is hereby corrected as shown below:

COLUMN 16:
Line 23, "above described" should read --above-described--.

COLUMN 18:
Line 20, "element" should read --member--.

Signed and Sealed this

Eighteenth Day of November, 2008

JON W. DUDAS
*Director of the United States Patent and Trademark Office*